United States Patent [19]

Kunii

[11] Patent Number: 4,716,992

[45] Date of Patent: Jan. 5, 1988

[54] OPERATING PANEL DEVICE FOR AN ELEVATOR SYSTEM

[75] Inventor: Kazushi Kunii, Inazawa, Japan

[73] Assignee: Mitsubishi Denki Kabushiki Kaisha, Japan

[21] Appl. No.: 904,283

[22] Filed: Sep. 8, 1986

[30] Foreign Application Priority Data

Sep. 9, 1985 [JP] Japan ..... 60-199235

[51] Int. Cl.[4] ..... B66B 3/00; G08B 5/36

[52] U.S. Cl. ..... 187/121; 187/130; 250/221

[58] Field of Search ..... 187/121, 130; 200/61.02, 61.93, DIG. 36; 250/221, 552, 553, 578

[56] References Cited

U.S. PATENT DOCUMENTS 4,042,067 8/1977 Mandel ..... 187/121

4,387,367 6/1983 Fisher ..... 250/221 X

*Primary Examiner*—William M. Shoop, Jr.

*Assistant Examiner*—W. E. Duncanson, Jr.

*Attorney, Agent, or Firm*—Leydig, Voit & Mayer

[57] ABSTRACT

An improved operating panel device for an elevator system is disclosed which can be constructed with a limited depth, and which involves no mechanically operating parts at those portions which are to be manipulated by passengers, providing a substantially extended service life, and which is also durable and relatively immune to vandalism or rough operation by passengers. The operating panel device comprises: an indicator panel having a plurality of indication marks described thereon; a plurality of first light-emitting elements for emitting light signals which pass along a surface of the indicator panel across the indication marks; and a plurality of light-receiving elements for receiving the light signals from the first light-emitting elements whereby when at least one of the light signals emitted from the first light-emitting elements passing across a specific one of the indication marks on the indicator panel is selectively interrupted, the light-receiving elements detects such a selective interruption of the at least one light signal and sends out to an appropriate control system an operation command signal corresponding to the specific indication mark.

17 Claims, 12 Drawing Figures

OPERATING PANEL DEVICE FOR AN ELEVATOR SYSTEM

BACKGROUND OF THE INVENTION

1. Field of the Invention

This invention relates to an operating panel device for an elevator system, and more particularly, to an improvement in such an operating panel device in which operation switches on an operator panel are formed of photoelectric means.

2. Description of the Prior Art

There has hitherto been known a conventional operating panel device for an elevator system which is disclosed in a Japanese Utility Model Application laid-open No. 59-33872 and which is illustrated in FIGS. 7 through 10. FIG. 7 is a perspective view of an elevator car seen in the direction from a car's interior toward an elevator hall; FIG. 8 is a schematic cross sectional view of an elevator car taken along the line VIII—VIII in FIG. 7; FIG. 9 is an enlarged front elevational view of a portion of an elevator car surrounded by a dotted line A in FIG. 7; and FIG. 10 is an enlarged cross sectional view taken along the line X—X in FIG. 9.

In FIG. 7, there is shown an elevator car 1 which includes a ceiling 2, side walls 3, a floor 4 and a car door 5 at a doorway 3*d*. The elevator car 1 also has a front or door-side wall 3*a* on which a conventional operating panel device 6 is installed.

In general, as clearly seen from FIG. 9, the operating panel device 6 has on its front panel 3*a* a variety of buttons including, for example, call buttons 6*a* for registering destination floors a door opening button 6*b* for intentionally opening the car door 5 or holding the car door 5 open for a longer duration than usual, a door closing button 6*c* for intentionally closing the car door 5 for an early start when a passenger gets in the elevator car 1, and an interphone button 6*d* for enabling a passenger in a closed elevator car 1 to communicate with the outside during emergencies such as when elevator car 1 has not landed at a normal floor due to a malfunction and the car door 5 is closed.

As illustrated in FIG. 10, mounted on the back side of a front panel 6*e* of the operating panel device 6 are switch units 7 which are adapted to be actuated by depression of the above-described various buttons and which are housed in a switch box or housing 8.

In this manner, the conventional operating panel device 6, including the various buttons 6*a* to 6*d*, the switch units 7, the switch housing 8 and the like, is usually installed on the front or door-side panel 3*a* adjacent the doorway 3*d* so that passengers in the elevator car 1 can operate the elevator system by means of the buttons 6*a* to 6*d* on the operating panel device 6.

With the conventional operating panel device 6 as constructed above, however, as shown in FIG. 10, the switch housing 8 requires a depth l of about several tens of millimeters so as to accommodate the switch units 7, as a consequence of which the door-side wall 3*a* of the elevator car 3, on which the operating panel device 6 is installed, must have a space h for receiving the switch housing 8, as illustrated in FIG. 8. On the other hand, if the operating panel device 6 is mounted on the side walls 3*b* or the rear wall 3*c* of the elevator car 1 having only a limited available space, there will be an undesirable interference thereof with other component members or devices of the elevator system.

In addition, the above-described switch buttons are mechanically operated so that there will be considerable wear and/or fatigue on the mechanical portions thereof after a long period of use, thus resulting in relatively short lifetimes for the switches. Moreover, there are certain restrictions and/or difficulties involved in taking effective measures for protecting the operating panel device from vandalism by thoughtless passengers such as drunks or some children.

SUMMARY OF THE INVENTION

In view of the above, the present invention is intended to obviate the above-described problems of the prior art, and has for its object the provision of an improved operating panel device for an elevator system which can be constructed with a limited depth, and which involves no mechanically operated parts at those portions which are to be manipulated by passengers, thus providing a substantially extended service life, and which is durable and free from trouble resulting from rough or mischievous operation by passengers.

In order to achieve the above object, according to the present invention, there is provided an operating panel device for an elevator system comprising:

an indicator panel having a plurality of indication marks described thereon;

a first light-emitting means for emitting light signals which pass along a surface of the indicator panel across the indication marks; and a light-receiving means for receiving the light signals from the first light-emitting means whereby when at least one of the light signals emitted from the first light-emitting means passing across a specific one of the indication marks on the indicator panel is selectively interrupted, the light-receiving means detects such a selective interruption of the at least one light signal to send out an operation command signal corresponding to the specific indication mark.

In one embodiment, the indication marks on the indicator panel are disposed in a single row, and the first light-emitting means comprises a plurality of light-emitting elements adapted to be arranged in a single row such that the light signals emitted from the first light-emitting elements pass across a corresponding one of the indication marks on the indicator panel.

The light-receiving means may comprise a plurality of light-receiving elements corresponding in number to the first light-emitting elements and disposed in a single row so as to receive the light signals from the first light-emitting elements.

In another embodiment, the indication marks on the operator panel are disposed in plural rows, and the first light-emitting means comprises a plurality of light-emitting elements disposed in two row such that the light signals emitted from a first row of the first light-emitting elements cross the light signals emitted from a second row of the first light-emitting elements at locations just above the respective indication marks on the indicator panel.

The light-receiving means may comprise a plurality of light-receiving elements corresponding in number to the first light-emitting elements and disposed in two rows so as to receive the light signals from the first light-emitting elements.

Some of the first light-emitting elements may be disposed in a longitudinal row and the others in a lateral row, and some of the light-receiving elements may be disposed in a longitudinal row and the others in a lateral row.

In case the operating panel device is installed on a wall of an elevator car, at least one of the first light-emitting means and the light-receiving means is preferably embedded in the wall of the elevator car.

In case the elevator system includes an elevator hall having a wall on which the operating panel device is installed, at least one of the first light-emitting means and the light-receiving means is preferably embedded in the wall of the elevator hall.

In a further embodiment, a reflection mirror means is disposed in a face-to-face relation to the first light-emitting means with the indication marks interposed therebetween for reflecting the light signals from the first light-emitting means, the light-receiving means being disposed at the side of the first light-emitting means such that it can receive the light signals reflected by the mirror means.

It is preferred that a second light-emitting means be disposed near the indication marks on the indicator panel and adapted to be actuated by a signal from the light-receiving means to illuminate a specific one of the indication marks.

The operating panel device may be mounted on the inner or outer surface of the car wall, and in the latter case, it is constructed such that the indicator panel is accessible from the car interior through a cut-out opening in the car wall. In either of the above cases, the indicator panel may comprise a part of the car wall.

The above and other objects, features and advantages of the present invention will become apparent from the following detailed description of a few presently preferred embodiments of the invention when taken in conjunction with the accompanying drawings.

DESCRITPTION OF THE PREFERRED EMBODIMENTS

Figure 1:
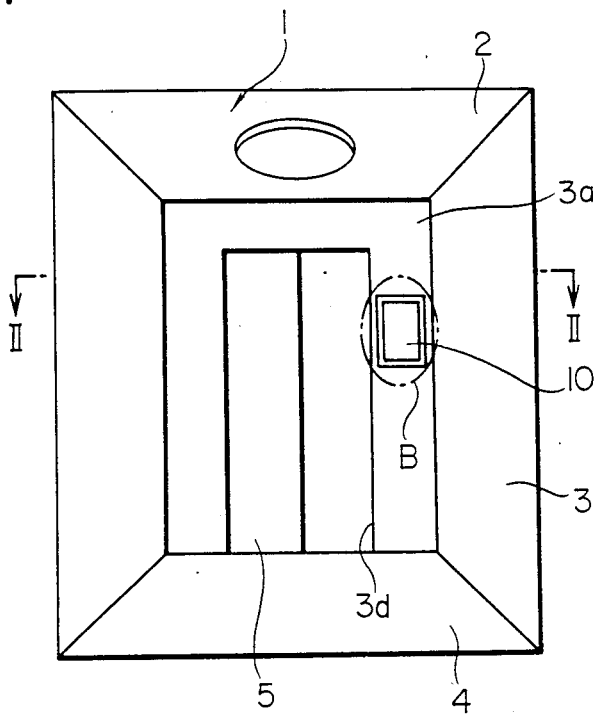
FIG. 1 is a perspective view showing an elevator car with an operating panel device installed thereon in accordance with one embodiment of the present invention.
Figure 2:
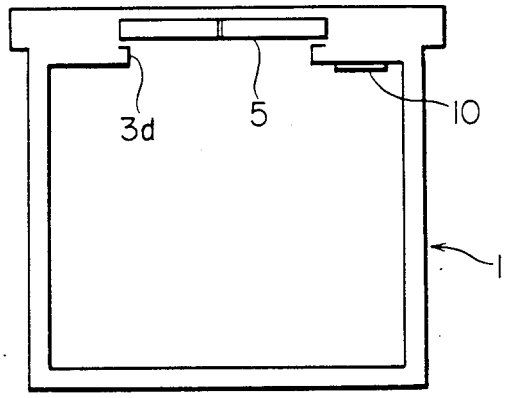
FIG. 2 is a schematic cross sectional view taken along the line II—II in FIG. 1.

Now, the present invention will be described in detail with reference to a few presently preferred embodiments thereof as illustrated in the accompanying drawings.

In the following description, the same or corresponding parts will be identified by the same reference numerals and characters as employed in FIGS. 7 to 10.

First, FIGS. 1 to 4 show a first embodiment of the present invention. In FIG. 1 there is shown an elevator car 1 having an operating panel device 10 installed on a front or door-side wall 3*a* at a location near a doorway 3*d* which is adapted to be closed by a car door 5.

Figure 3A:
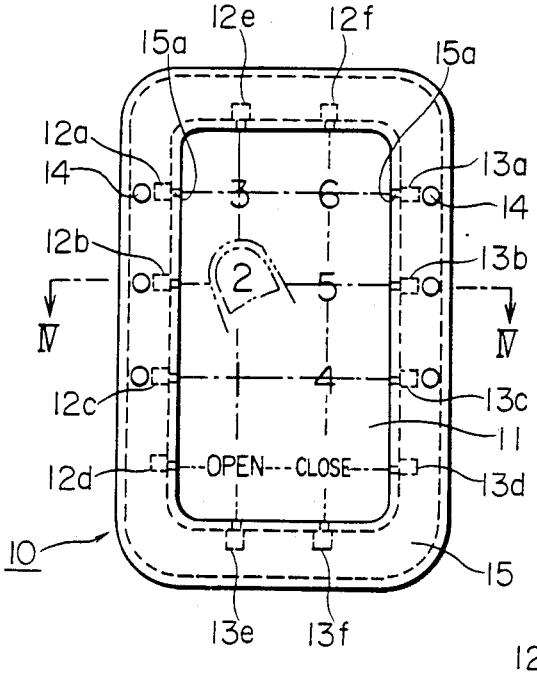
FIG. 3A is an enlarged front elevational view of the operating panel device illustrated in FIG. 1.
Figure 4:
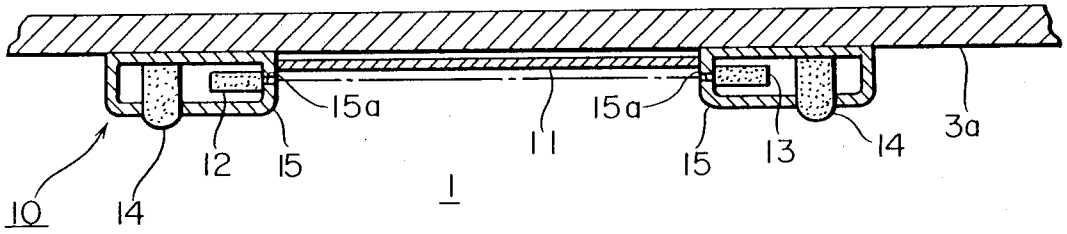
FIG. 4 is an enlarged cross sectional view taken along the line IV—IV in FIG. 3A.

As seen from FIGS. 3A and 4, the operating panel device, generally designated by reference numeral 10, comprises an indicator panel 11 of a generally rectangular shape formed of transparent glass or plastic and having a variety of indication marks described as by printing on its back side surface, the indication marks being disposed in double vertical rows in a lattice-like pattern and including, for example, floor number marks such as "1" through "6" representative of the first to sixth floors, respectively, and instruction marks such as "OPEN" and "CLOSE" representative of door-opening and door-closing operations, respectively; a first light-emitting means 12 for continuously emitting, during the operation of the elevator system, light signals or beams which pass along the surface of the indicator panel 11 across the indication marks thereon; a light-receiving means 13 adapted to receive the light signals or beams emitted from the first light-emitting means 12 and send out an output signal such as an operation command signal to an appropriate control system (not shown); a second light-emitting means 14 disposed near the indication marks on the indicator panel 11 for selectively illuminating a specific one of the indication marks; and a switch box or housing 15 in the form of a rectangular-shaped loop-like configuration attached to the door-side panel 3*a* for receiving therein the first lightning means 12, the light-receiving means 13 and the second light-emitting means 14, the housing 15 being disposed to surround and firmly hold, at its inner periphery, the outer periphery of the indicator panel 11.

The first light-emitting means 12 comprises a longitudinal row of first light-emitting elements 12*a* through 12*d* disposed vertically or longitudinally within the switch housing 15 on one side (on the lefthand side in FIG. 3A) of the indicator panel 11 at locations corresponding horizontally to the vertical positions of the indication marks on the indicator panel 11, and a lateral row of first light-emitting elements 12*e* and 12*f* disposed horizontally or laterally within the switch housing 15 on one end (on the upper end in FIG. 3A) of the indicator panel 11 at locations corresponding vertically to the lateral positions of the indication marks on the indicator panel 11. These light-emitting elements 12*a* through 12*f* are arranged such that they can emit light beams passing along and near the surface of the indicator panel 11 with the laterally advancing light beams from the longitudinal row of light-emitting elements 12*a* through 12*d* crossing the longitudinally advancing light beams from the lateral row of light-emitting elements 12*e*, 12*f*.

The light-receiving means 13 comprises a longitudinal row of light-receiving elements 13*a* through 13*d* mounted on the other side (on the righthand side in FIG. 3A) of the switch housing 15 at locations corresponding to the longitudinal row of first light-emitting elements 12*a* through 12*d*, and a lateral row of light-receiving elements 13*e*, 13*f* mounted on the other end (on the lower end in FIG. 3A) of the switch housing 15 at locations corresponding to the lateral row of first light-emitting elements 12*e*, 12*f*. These light-receiving elements 13*a* through 13*f* are arranged such that they can receive the light beams emitted from the corresponding first light-emitting elements 12*a* through 12*f* if the light beams are not interrupted.

The second light-emitting means 14 comprises a plurality of light-emitting elements in the form of light-emitting diodes mounted on the switch housing 15 on its opposite sides (on the righthand and lefthand sides in FIG. 3A) at locations corresponding to the numerical marks on the indicator panel 11 representative of the respective floor numbers.

As clearly seen from FIG. 4, the switch housing 15 has throughholes 15*a* formed in the inner peripheral wall thereof for passage of the light beams emitted from the first light-emitting elements 12*a* through 12*f*. The second light-emitting elements 14*a* through 14*f* have their round tip ends slightly projected outward from the surface of the switch housing 15.

The operating panel device 10 of this embodiment is constructed in the following manner. When a finger of a passenger in the elevator car 1 is placed on a specific one of the indicator marks and a specified combination of the light signals emitted from the first light-emitting elements 12*a* through 12*f* toward the light-receiving elements 13*a* through 13*f* in the longitudinal and lateral directions are selectively interrupted by the passenger's finger, the light-receiving elements 13*a* through 13*f* act to detect such an interruption of the specified combination of the light signals so that they output an elevator-operation command signal corresponding to the specific indicator mark selected by the passenger and at the same time actuate a specified one of the second light-emitting elements 14 corresponding to the selected indication mark so as to indicate the issuance of the elevator-operation command signal.

In operation, when a passenger in the elevator car 1 puts one of his fingers, for example, on the indication mark "2" on the indicator panel 11 for designation of the second floor, as illustrated by dotted lines in FIG. 3A, this floor number "2" as selected is detected or recognized as follows. Specifically, the specific light signals or beams issued from the first light-emitting element 12*b* on the longitudinal row and from the first light-emitting element 12*e* on the later row are interrupted by the passenger's finger and do not reach the corresponding light-receiving elements 13*b* and 13*e* so that selection of the second floor is detected or determined by a particular combination of the specific light-receiving elements 13*a* and 13*e* in the longitudinal and lateral rows, respectively, and simultaneous with this, an operation command signal is sent out to an appropriate control system for stopping the elevator car 1 at the second floor while lighting a nearby second light-emitting element for informing the passenger of the issuance of such an operation command signal.

Figure 3B:
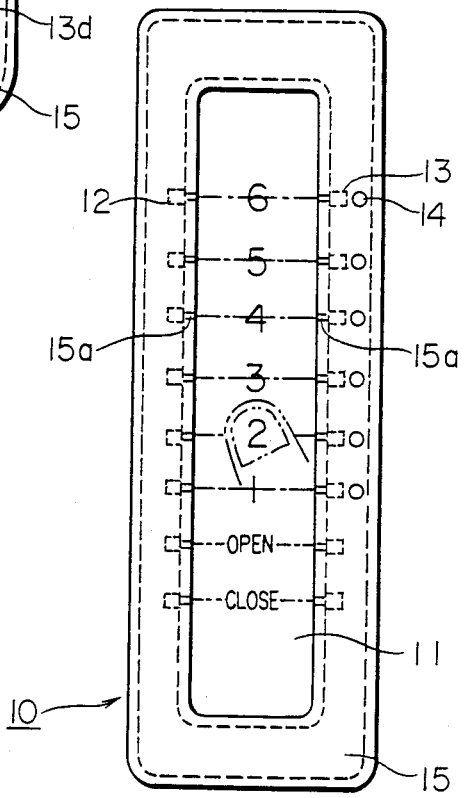
FIG. 3B is a view similar to FIG. 3A, showing a modified form of operating panel device.

FIG. 3B shows an operating panel device in accordance with a second embodiment of the present invention in which a variety of indication marks including floor-number marks and door-open and door-close marks on an elongated indicator panel 11 are linearly disposed in a single vertical or longitudinal row. In this embodiment, a first light-emitting means 12 having plural first light-emitting elements and a light-receiving means 13 including the same number of light-receiving elements are disposed in respective longitudinal rows on the opposite sides of an elongated loop-like switch housing 15 at locations respectively corresponding to the indication marks, and a second light-emitting means 14 including plural second light-emitting elements is disposed in a single longitudinal row on one side of the switch housing 15 at locations near the respective light-receiving elements and corresponding to the floor-number marks "1" through "6".

In operation of this second embodiment, the light signal or beam from one of the first light-emitting elements corresponding to a specific one of the indication marks on which one of the fingers of a passenger in an elevator car 1 is placed is selectively interrupted by the finger so that a specific one of the light-receiving elements corresponding to the specified first light-emitting element can not receive the light beam. As a result, the specified light-receiving element can detect such interruption and output an operation command signal such as one for stopping the elevator car at a designated or selected floor while simultaneously lighting one of the second light-emitting elements corresponding to the selected floor-number mark so as to inform the passenger of the issuance of such an operation command signal.

Figure 5A:
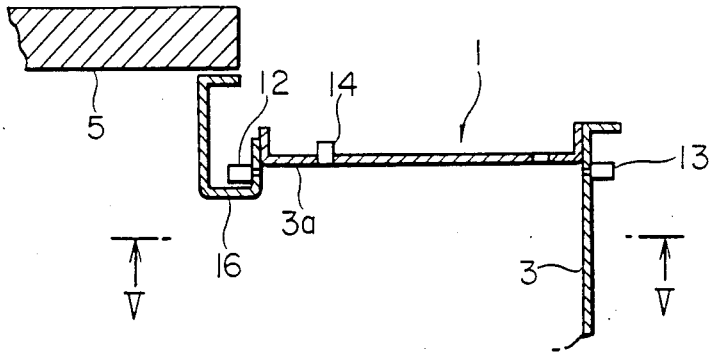
FIG. 5A is an enlarged cross sectional view showing a part of an elevator car with an operating panel device installed thereon in accordance with another embodiment of the present invention.
Figure 5B:
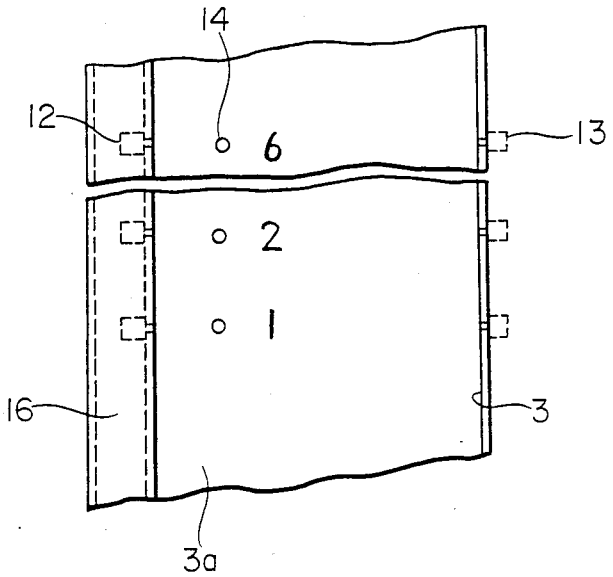
FIG. 5B is a view seen in the direction of the arrows V in FIG. 5A.
Figure 7:
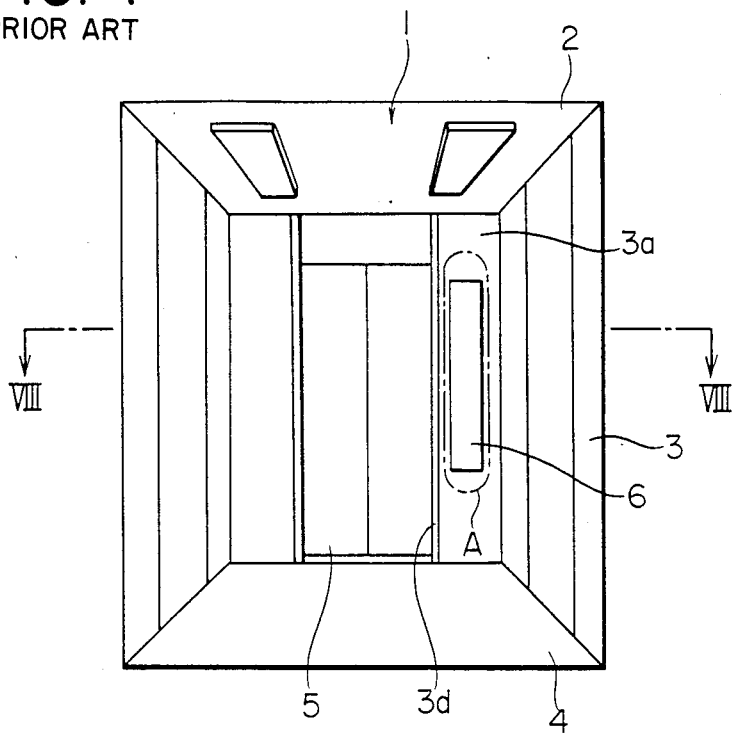
FIG. 7 PRIOR ART
FIG. 7 is a perspective view showing an elevator car with a conventional operating panel device installed thereon.
Figure 8:
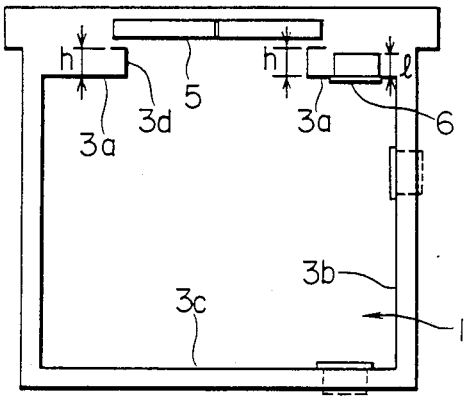
FIG. 8 PRIOR ART
FIG. 8 is a schematic cross sectional view taken along the line VIII—VIII in FIG. 7.
Figure 9:
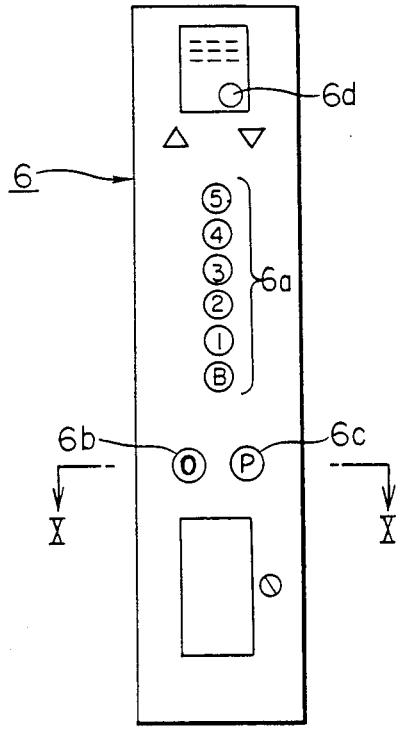
FIG. 9 PRIOR ART
FIG. 9 is an enlarged front elevational view of the operating panel device encircled by the dotted line A in FIG. 7.
Figure 10:
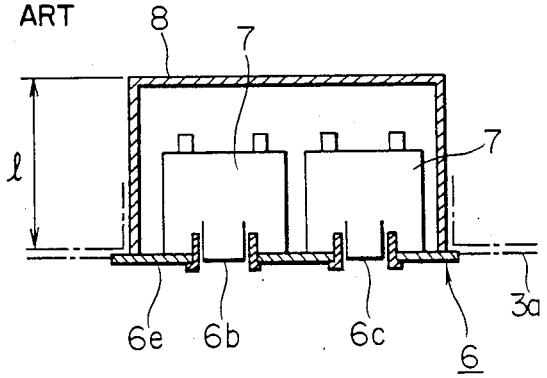
FIG. 10 PRIOR ART
FIG. 10 is an enlarged cross sectional view taken along the line X—X in FIG. 9.

FIGS. 5A and 5B show a third embodiment of the present invention. In this embodiment, as illustrated in these figures, an indicator panel having various indication marks such as floor numbers "1" through "6" and the like is integrally formed with or constituted by a part of a front or door-side wall 3*a* of an elevator car 1. A first light-emitting means 12 including a plurality of first light-emitting elements is housed in and mounted on an entrance column 12 with the first light-emitting elements disposed in a vertical row at locations respectively corresponding to the indication marks, and a light-receiving means 13 including the same number of light-receiving element is imbedded in one side wall 3 of an elevator car 1 with the respective light-receiving elements disposed in a vertical row at locations corresponding to the first light-emitting elements so as to receive light signals or beams emitted from the corresponding first light-emitting elements. A second light-emitting means 14 including plural second light-emitting elements corresponding in number to the indication marks are imbedded in the door-side wall 3*a* of the elevator car 1 at locations near the respective indication marks with their tip ends projected slightly from the door-side wall 3*a*. In this connection, it should be noted that, instead of the above arrangement, the first light-emitting means 12 and the light-receiving means 13 may be imbedded in the car side wall 3 and the entrance column 16, respectively. With the above arrangement, the first light-emitting means 12 and the light-receiving means 13 are behind the walls of the entrance column 16 and the elevator car 1 so that they can not be seen or perceived by passengers in the elevator car 1, thus imparting a novel and wondrous feeling to the passengers.

Figure 6:
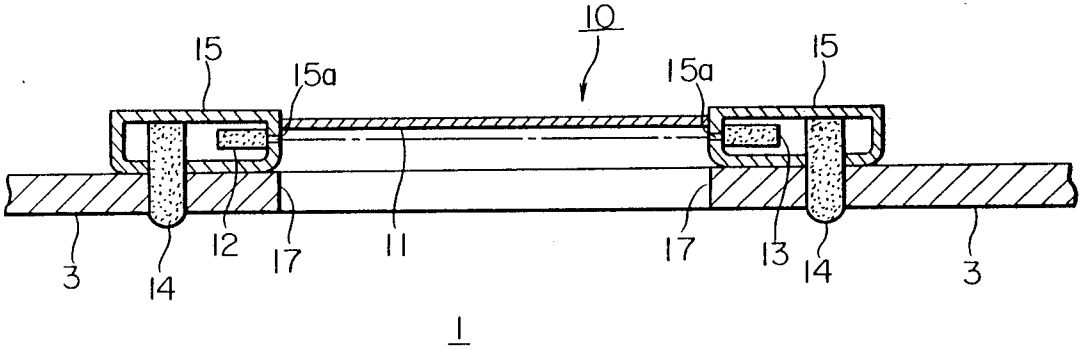
FIG. 6 is an enlarged cross sectional view similar to FIG. 6, showing an operating panel device installed on a car wall in accordance with a further embodiment of the present embodiment.

FIG. 6 shows a fourth embodiment of the present invention. In this figure, an operating panel device 10 of this embodiment is illustrated in a cross sectional representation similar to FIG. 4, and mounted on the back side (on the upper side in FIG. 6) of a car wall 3 of which the lower surface faces the interior of an elevator car 1. The construction and arrangement of this embodiment are substantially similar to those of the aforementioned first embodiment illustrated in FIGS. 1, 2, 3A and 4 with the exception that all the component parts are arranged behind the car wall 3 which has a cut-out opening 17 through which passengers in the elevator car 1 can look at indication marks on an indicator panel 11 mounted on the back surface of the car wall 3. In this embodiment, there are no protrusions present on the inner surface of the car wall 3 which would otherwise impose restraints on the location of installation of the operating panel device 10. Therefore, it is possible to freely install the operating panel device 10 at various positions of the elevator car 1 and thus it can be mounted on a car door 5 without interfering with the opening and closing operations thereof.

Although in the above-described embodiments, the first light-emitting means 12 and the light-receiving means 13 are disposed in a face-to-face relation with each other, a reflection mirror means may be provided at a location opposing the first light-emitting means 12 for reflection of light beams from the light-emitting means 12, and a light-receiving means 13 may be disposed at the same side as the light-emitting means 12 so as to receive the light beams reflected by the mirror means.

Also, in the above embodiments, the present invention is applied to an operating panel device installed on an elevator car but instead may be likewise applicable to an operating panel device mounted at a floor or hall side while attaining the same effects.

Further, although in the foregoing description, the indication marks on the indicator panel comprise numbers and letters indicative of floor numbers and door operations, respectively, they may comprise patterns, codes, illustrations and the like described as by printing on the indicator panel for indicating the same or additional meanings.

In addition, in the above embodiments, the indication marks such as the floor number marks and the door-open and door-close marks on the indicator panel are disposed in the vertical or longitudinal direction but instead may be disposed in an arbitrary manner, for example, in a horizontal or lateral direction or in an oblique direction.

To summarize, according to the present invention, an operating panel device is constructed such that light signals or beams emitted from a light-emitting means pass along a surface of an indicator panel across indication marks thereon and are received by a light-receiving means, and that when a passenger in an elevator car puts one of his fingers on an appropriate one of the indication marks, a specific one of the light signals passing across the specific indication mark selected by the passenger is interrupted by the finger and does not reach the corresponding light-receiving means which then sends out to an appropriate control system for the elevator an operation command signal corresponding to the specific indication marks selected by the passenger. With this construction, it is possible to materially reduce the thickness of the entire operating panel device and therefore there will be no need for embedding the operating panel device into a side wall of an elevator car, thus omitting any cut-out opening conventionally formed in the side wall for installation of the operating panel device. Also, when mounted on a car wall, the operating panel device of the invention will provide no substantial protrusions on the inner surface of the car wall. As a result, the operating panel device can be installed, in addition to a front or door-side wall of the elevator car, on a side wall or a rear wall thereof. Moreover, the manipulative portion visible by the passengers is only the indicator panel mounted on a surface of the car wall and there are no mechanically operated parts such as sliding parts, mechanical switching parts or the like, as a consequence of which no detector or operation members such as push buttons appear on the car wall surface, thereby providing a novel and singular design. If, for example, the indicator panel is formed of transparent glass and superposed on the car wall surface, as illustrated in FIG. 4, the passengers can see the wall surface through the transparent indicator panel, recognizing the absence of any component parts behind the indicator panel and arousing their curiosity and wonderment.

Further, due to the absence of any mechanically operated parts such as push button switches, the operating panel device of the present invention as a whole is not subject to wear and/or damage resulting from mechanical movements such as sliding movements between the component parts, and is highly durable against rough operation thereof as by drunken passengers or vandals, thus enabling prolongation of the service life thereof and enhancement of the operational reliability thereof.

What is claimed is:

1. An operating panel device for an elevator system comprising:

an indicator panel having a plurality of indication marks described thereon;

a first light-emitting means for emitting light signals which pass along a surface of said indicator panel across said indication marks;

a light-receiving means for receiving the light signals from said first light-emitting means whereby when at least one of the light signals emitted from said first light-emitting means passing across a specific one of said indication marks on said indicator panel is selectively interrupted, said light-receiving means detects such a selective interruption of the at least one of the light signals to send out an operation command signal corresponding to the specific indication mark; and a second light-emitting means mounted on said indicator panel near each of and corresponding to the indication marks and connected to be activated to emit light in response to an operation command signal to indicate that the corresponding specific indicator mark is selectively interrupted.

2. An operating panel device for an elevator system as claimed in claim 1 wherein said indication marks on said indicator panel are disposed in a single row, said first light-emitting means comprising a plurality of light-emitting elements adapted to be arranged in a single row such that the light signals emitted from said first light-emitting elements pass across a corresponding one of said indication marks on said indicator panel.

3. An operating panel device for an elevator system as claimed in claim 2 wherein said light-receiving means comprises a plurality of light-receiving elements corresponding in number to said first light-emitting elements and disposed in a single row so as to receive the light signals from said first light-emitting elements.

4. An operating panel device for an elevator system as claimed in claim 1 wherein said indication marks on said operator panel are disposed in plural rows, said first light-emitting means comprising a plurality of light-emitting elements disposed in two rows such that the light signals emitted from a first row of said first light-emitting elements cross the light signals emitted from a second row of said first light-emitting elements at locations just above said respective indication marks on said indicator panel.

5. An operating panel device for an elevator system as claimed in claim 4 wherein said light-receiving means comprises a plurality of light-receiving elements corresponding in number to said first light-emitting elements and disposed in two rows so as to receive the light signals from first said light-emitting elements.

6. An operating panel device for an elevator system as claimed in claim 4 wherein some of said first light-emitting elements are disposed in a longitudinal row and the others in a lateral row.

7. An operating panel device for an elevator system as claimed in claim 5 wherein some of said light-receiving elements are disposed in a longitudinal row and the others in a lateral row.

8. An operating panel device for an elevator system as claimed in claim 1 wherein said elevator system includes an elevator car having a wall on which said operating panel device is installed, at least one of said first light-emitting means and said light-receiving means being embedded in the wall of said elevator car.

9. An operating panel device for an elevator system as claimed in claim 1 wherein said elevator system includes an elevator hall having a wall on which said operating panel device is installed, at least one of said first light-emitting means and said light-receiving means being embedded in the wall of said elevator hall.

10. An operating panel device for an elevator system as claimed in claim 1 further comprising a reflection mirror means disposed in a face-to-face relation to said first light-emitting means with said indication marks interposed therebetween for reflecting the light signals from said first light-emitting means, said light-receiving means being disposed at the side of said first light-emitting means such that it can receive the light signals reflected by said mirror means.

11. An operating panel device for an elevator systems as claimed in claim 1 wherein said elevator system includes an elevator car having a side wall, said operating panel device being mounted on the inner surface of said car wall.

12. An operating panel device for an elevator system as claimed in claim 11 wherein said indicator panel comprises a part of said car wall.

13. An operating panel device for an elevator system as claimed in claim 1 wherein said elevator system includes an elevator car having a side wall with a cut-out opening formed therethrough, said operating panel device being mounted on the outer surface of said car wall in a manner such that said indicator panel is accessible from the car interior through the cut-out opening in said car wall.

14. An operating panel device according to claim 1, said panel device including a switch housing having opposing walls;

said first light-emitting means comprising a plurality of light-emitting elements mounted within said switch housing;

said switch housing having holes in the opposing walls corresponding to the light-emitting elements and passing light signals emitted from said emitting elements across the indication marks; and said light-receiving means comprising elements mounted within said housing and receiving the light signals passed through the holes.

15. An operating panel device according to claim 14, said second light-emitting means comprising a plurality of light-emitting devices corresponding to the indication marks, respectively, each of said second light-emitting devices being mounted within said switch housing adjacent one of said elements.

16. An operating panel device according to claim 14, said second light-emitting means comprising a plurality of light-emitting devices corresponding to the indication marks, respectively, each of said second light-emitting devices being mounted within said switch housing adjacent one of said light-receiving and light-emitting elements:

17. An operating panel device according to claim 15, said switch housing having a front wall, said light-emitting devices each extending through said front wall of said switch housing to be visible from in front of the front wall of said housing.

* * * * *